US010406449B2

(12) United States Patent
Walterscheid

(10) Patent No.: US 10,406,449 B2
(45) Date of Patent: Sep. 10, 2019

(54) VIBRATING TOY

(71) Applicant: FSD, LLC, Bend, OR (US)

(72) Inventor: Steven Edward Walterscheid, Bend, OR (US)

(73) Assignee: FSD, LLC, Bend, OR (US)

( * ) Notice: Subject to any disclaimer, the term of this patent is extended or adjusted under 35 U.S.C. 154(b) by 0 days.

(21) Appl. No.: 15/990,023

(22) Filed: May 25, 2018

(65) Prior Publication Data

US 2019/0143229 A1 May 16, 2019

Related U.S. Application Data

(60) Provisional application No. 62/586,034, filed on Nov. 14, 2017.

(51) Int. Cl.

| | |
|---|---|
| ***A63H 11/02*** | (2006.01) |
| ***A63H 17/26*** | (2006.01) |
| ***A63H 29/22*** | (2006.01) |
| ***A63H 3/08*** | (2006.01) |

(52) U.S. Cl.

CPC ..... *A63H 11/02* (2013.01); *A63H 3/08* (2013.01); *A63H 17/26* (2013.01); *A63H 29/22* (2013.01)

(58) Field of Classification Search

CPC ..... A63H 11/02; A63H 3/08; A63H 17/26; A63H 29/22

USPC ..... 446/295, 354–356, 369, 456, 462, 465, 446/484

See application file for complete search history.

(56) References Cited

U.S. PATENT DOCUMENTS

| | | | | |
|---|---|---|---|---|
| 2,167,985 A | | 8/1939 | Levay | |
| 3,196,580 A | | 7/1965 | Rakestraw | |
| 3,234,933 A | * | 2/1966 | Martin | A61H 23/0263 601/41 |
| 3,530,617 A | | 9/1970 | Halvorson | |
| 4,183,173 A | | 1/1980 | Ogawa | |
| 4,391,223 A | * | 7/1983 | Holland | A01K 1/033 119/499 |
| 4,759,642 A | * | 7/1988 | Van Erden | B65D 31/00 229/117.35 |
| 4,941,857 A | | 7/1990 | Fujimaki | |
| 5,117,815 A | | 6/1992 | Gentry et al. | |
| 5,163,381 A | * | 11/1992 | Kraski | A01K 1/033 119/28.5 |
| 5,221,226 A | * | 6/1993 | Park | A63H 18/007 446/353 |
| 5,524,326 A | * | 6/1996 | Markowitz | A01K 15/025 119/482 |
| 5,679,047 A | | 10/1997 | Engel | |
| 5,720,644 A | * | 2/1998 | Ku | A63H 11/00 446/175 |

(Continued)

*Primary Examiner* — Nini F Legesse

(74) *Attorney, Agent, or Firm* — LaMorte & Associates P.C.

(57) ABSTRACT

A vibrating toy assembly that can travel along a surface in an unpredictable pattern. The toy assembly is powered by a vibration mechanism. The vibration mechanism has a motor and batteries that are held in a housing. The vibration mechanism is placed into a hollow casing. The hollow casing defines an internal compartment. Once activated, the vibration mechanism vibrates and changes orientation within the casing. As the vibration mechanism changes orientations, the movement patterns of the casing are altered. This causes the overall toy assembly to move in random patterns.

17 Claims, 6 Drawing Sheets

(56) References Cited

U.S. PATENT DOCUMENTS

| | | | | |
|---|---|---|---|---|
| 5,765,508 | A * | 6/1998 | Markowitz | A01K 15/025 119/707 |
| 5,993,286 | A | 11/1999 | Tacquard | |
| 8,038,503 | B2 | 10/2011 | Norman et al. | |
| 2008/0306417 | A1 | 12/2008 | Imboden et al. | |
| 2011/0147442 | A1* | 6/2011 | Griffin | B65D 5/60 229/117.27 |
| 2012/0100777 | A1 | 4/2012 | Hsu | |
| 2013/0095723 | A1 | 4/2013 | Sadri et al. | |
| 2014/0094088 | A1 | 4/2014 | Olivera et al. | |
| 2016/0339352 | A1* | 11/2016 | Liu | A63H 33/16 |
| 2017/0008671 | A1* | 1/2017 | Whitman | B65D 21/086 |

* cited by examiner

VIBRATING TOY

RELATED APPLICATIONS

This application claims benefit of U.S. Provisional Application No. 62/586,034, filed Nov. 14, 2017.

BACKGROUND OF THE INVENTION

1. Field of the Invention

In general, the present invention relates to toys that move on a surface due to an internal vibrating mechanism. More particularly, the present invention relates to the structure of the toy and the internal compartment that retains the internal vibration mechanism.

2. Prior Art Description

There are many toys that are designed to vibrate. Many of these toys use vibration mechanisms to move the toy across a surface. The vibration mechanism used within the toy often includes a small battery powered motor. The motor is used to turn an eccentric weight that is mounted to the motor. As the eccentric weight is rotated by the motor, a strong mechanical vibration is created that shares the same frequency as the rotational speed of the eccentric weight. Toys that utilize such vibration mechanisms are exemplified by U.S. Pat. No. 4,941,857 to Fujimaki, and U.S. Patent Application Publication No. 2012/0100777 to Hsu.

In the prior art, the motor used to rotate the eccentric weight is typically set into a fixed position within the structure of the toy. The eccentric weight rotates in a fixed compartment adjacent to the motor. The weight distribution within the toy and its center of gravity remains relatively constant, with only small variations caused by the rotational movement of the eccentric weight. Accordingly, the effects of the rotating weight on the overall toy remain relatively constant each time the motor is activated. The result is that each time the toy is utilized, the movements of the toy caused by the rotating weight remain standard and predictable.

Additionally, since the vibration mechanism is set within the toy, the toy is set in shape and appearance. This limits the play value of the toy because a user can quickly become bored with the fixed appearance and fixed movement pattern embodied by the toy.

A need exists for a toy with an internal vibration mechanism that has the ability to randomly change its weight distribution and center of gravity as it vibrates. The changes in weight distribution and center of gravity translate into random and altering movement patterns as the toy is propelled along a surface.

A need also exists for a toy with an internal vibration mechanism, wherein the facade of the toy can be altered, therein selectively changing the appearance of the toy.

These needs are met by the present invention as described and claimed below.

SUMMARY OF THE INVENTION

The present invention is a vibrating toy assembly that can travel along a surface in an unpredictable pattern. The toy assembly is powered by a vibration mechanism. The vibration mechanism has a motor and batteries that are held in a housing. When the batteries power the motor, the motor turns an eccentric weight and vibrations are produced.

The vibration mechanism is placed into a hollow casing. The hollow casing defines an internal compartment having a bottom surface and at least one side wall, wherein said internal compartment is large enough to receive the vibration mechanism in a variety of orientations.

The vibration mechanism is positioned within the internal compartment and activated. Once activated, the vibration mechanism vibrates and changes orientation within the casing. As the vibration mechanism changes orientations, the movement patterns of the casing are altered. This causes the overall toy assembly to move in random patterns. Additionally, since the vibration mechanism is separate and distinct from the casing, different casing can be used to increase the play value of the vibrating toy assembly.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy assembly can have many embodiments, only a few exemplary embodiments are shown. The exemplary embodiments are selected in order to set forth some of the best modes contemplated for the invention. The illustrated embodiments, however, are merely exemplary and should not be considered limitations when interpreting the scope of the claims.

Figure 1:
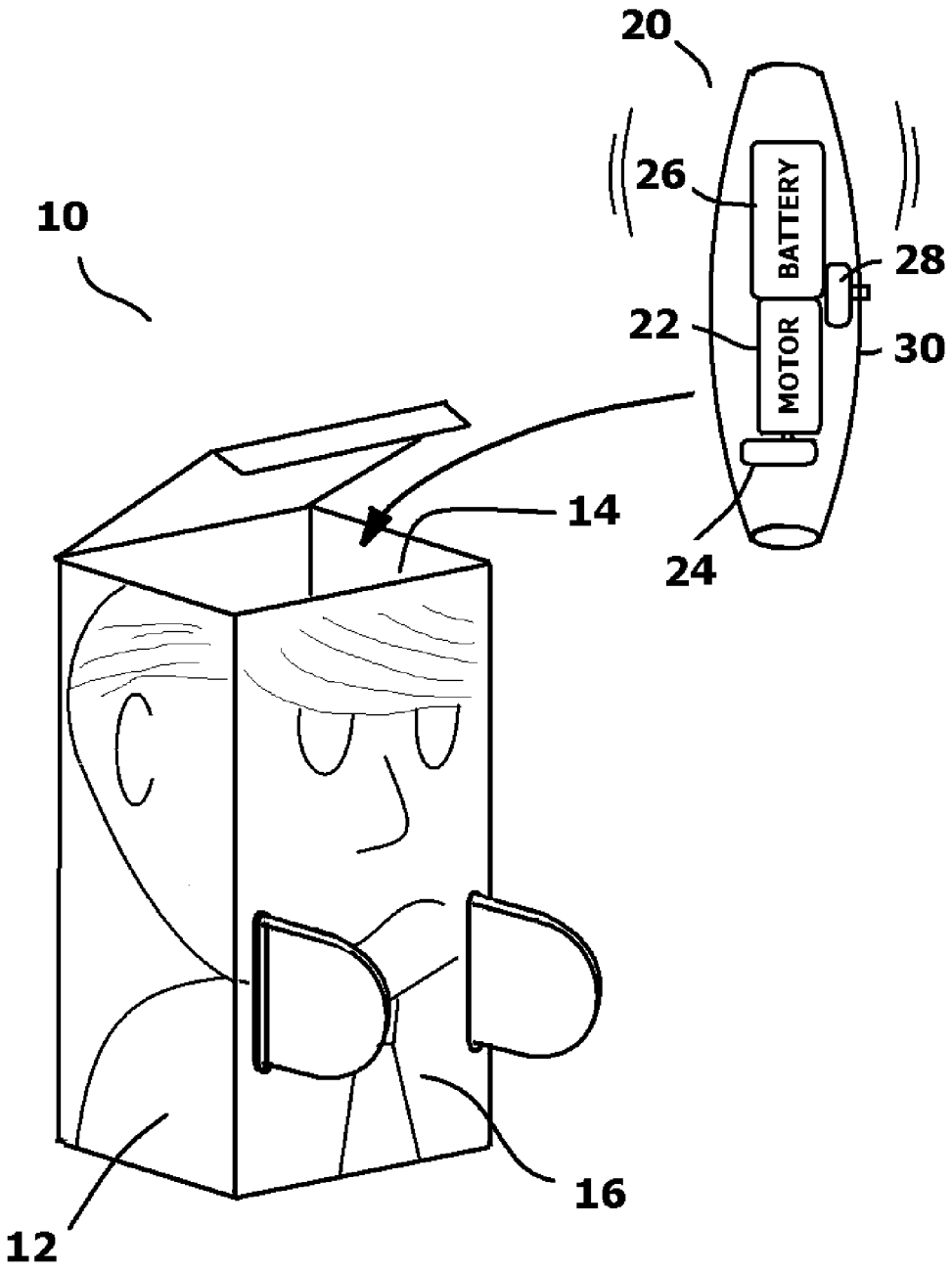
FIG. 1 is a partially exploded view of an exemplary embodiment of a vibrating toy assembly.
Figure 2:
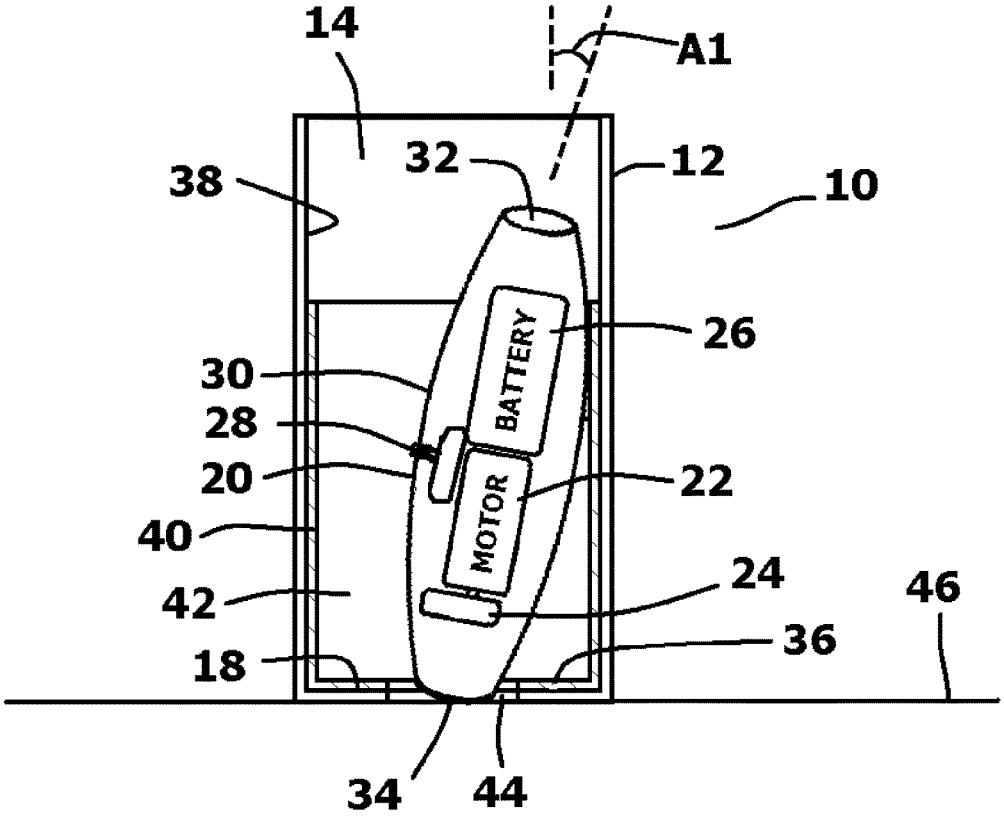
FIG. 2 is a cross-sectional view of the exemplary embodiment of FIG. 1.

Referring to FIG. 1 in conjunction with FIG. 2, a toy assembly 10 is shown. The toy assembly 10 includes a lightweight casing 12 that defines a hollow internal compartment 14. As will later be explained, the casing 12 can be made of folded paper or folded paperboard, wherein character graphics 16 are printed on the exterior of the casing 12. The casing 12 has a flat bottom surface 18 that enables the casing 12 to be free standing.

A vibration mechanism 20 is placed into the internal compartment 14 of the casing 12. The vibration mechanism 20 has a motor 22 that rotates an eccentric weight 24, therein causing vibrations in a traditional manner. The motor 22 is powered by a battery 26. The flow of electricity from the battery 26 to the motor 22 is selectively controlled using an on/off switch 28. The motor 22, eccentric weight 24, battery 26 and on/off switch 28 are all retained in a housing 30. It will therefore be understood, that when the on-off switch 28 is turned "on", the motor 22 rotates the eccentric weight 24 and the entire housing 30 vibrates along with its contents.

The housing 30 of the vibration mechanism 20 is elongated between a first end 32 and second end 34. As such, the housing 30 has a length that is significantly longer than its width. Furthermore, due to the position of the eccentric weight 24, the vibration mechanism 20 has a center of gravity that varies and that is not at the geometric center of the housing 30. Additionally, the two ends 32, 34 of the housing 30 need not be flat. The result is that when the housing 30 of the vibration mechanism 20 is stood upon either of its ends 32, 34, the vibration mechanism 20 is unstable and will naturally fall to the side, even when not vibrating.

The vibration mechanism 20 is placed into the internal compartment 14 of the casing 12. Within the casing 12, the internal compartment 14 has a base 36 and peripheral sidewalls 38. The base 36 has a length and a width. The sidewalls 38 have a given height. The length and the width of the base 36 within the internal compartment 14 are smaller than the length of the vibration mechanism 20. Accordingly, the only way the vibration mechanism 20 will fit into the internal compartment 14 is to orient the vibration mechanism 20 so that one of the ends 32, 34 of the vibration mechanism 20 rest upon the base 36. This will cause the vibration mechanism 20 to lean at an angle inside the internal compartment 14 of the casing 12. Consequently, the vibration mechanism 20 will lean against one or more of the side walls 38 of the casing 12. The center of gravity for the overall toy assembly 10, therefore, depends upon the position of the vibration mechanism 20 within the internal compartment 14 of the casing 12 at any given point in time.

As will be explained, the casing 12 can be made from a variety of materials, including folded paper. If the structural integrity of the material is too insubstantial to support the vibration mechanism 20, then a secondary liner 40 can be used. Such a secondary liner 40 is shown in FIG. 2. The secondary liner 40 is a shaped cup of molded plastic that is inserted into the internal compartment 14 of the casing 12. The secondary liner 40 covers the base 36 and at least some of the sidewalls 38 of the casing 12, therein providing integral support to these surfaces. The secondary liner 40 defines a pocket 42 that is only slightly smaller than the areas of the internal compartment 14 that it covers. The pocket 42 remains larger than the width of the vibration mechanism 20. Accordingly, the vibration mechanism 20 is free to move within the limits of the pocket 42.

Figure 3:
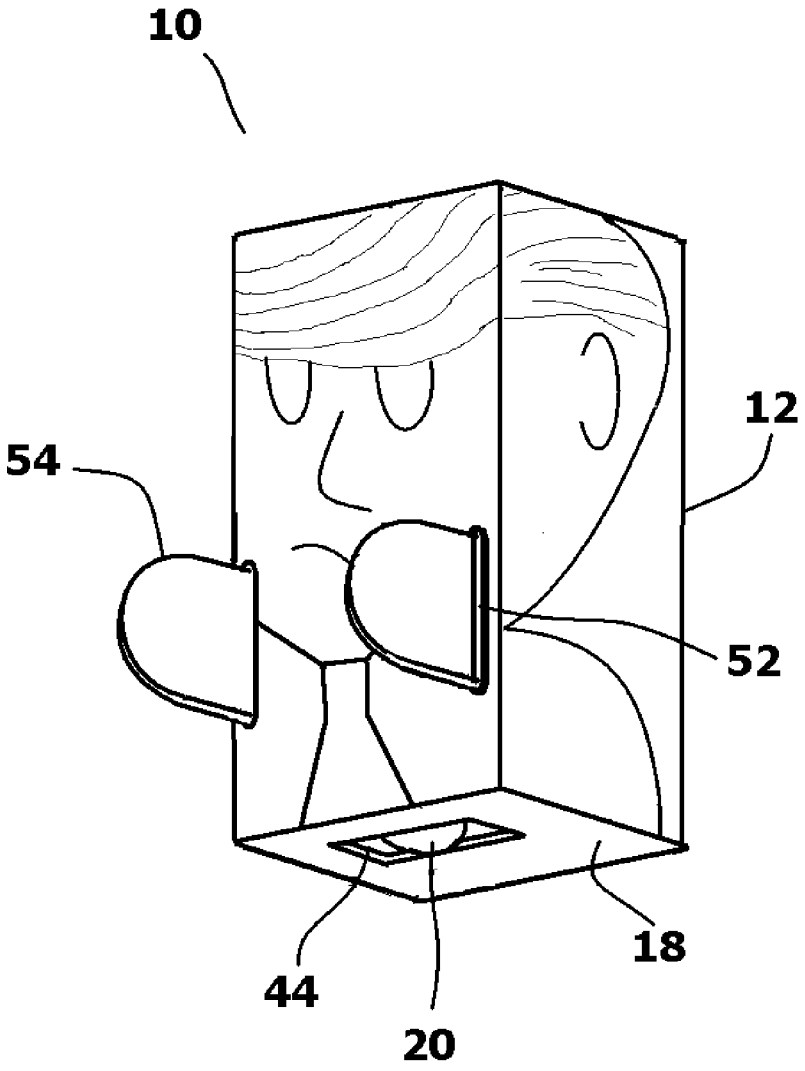
FIG. 3 is a bottom perspective view of the exemplary embodiment.

Referring to FIG. 3 in conjunction with FIG. 2, it can be seen that the bottom surface 18 of the casing 12 need not be solid. Rather, the bottom surface 18 defines one or more open windows 44. The open windows 44 align with equivalent windows in the liner 40, should a liner 40 be present. The windows 44 provide access to the internal compartment 14 from outside the casing 12. The windows 44 also provide access to the areas outside the internal compartment 14 from within the internal compartment 14.

The vibration mechanism 20 can fit inside the internal compartment 14 of the casing 12 in a multitude of different orientations. The orientation of the vibration mechanism 20 within the casing 12 greatly affects the center of gravity for the overall toy assembly 10. In some orientations, the vibration mechanism 20 is leaning in a first direction within the internal compartment 14. In other orientations, the vibration mechanism 20 leans in different directions. Furthermore, the angle of inclination A1 against any of the walls 38 can vary within a wide range. The range is typically between 10 degrees and 40 degrees. However, a larger range can be achieved if the internal compartment 14 is significantly larger than the vibration mechanism 20. However, the internal compartment 14 should never be so large that the vibration mechanism 20 can fall flat against the bottom surface 18 of the internal compartment 14.

In some orientations, the vibration mechanism 20 rests upon one of the windows 44 in the bottom surface 18 of the casing 12. When in such an orientation, the vibration mechanism 20 can contact the surface 46 outside the casing 12 upon which the casing 12 rests. In other orientations, the vibration mechanism 20 can rest upon the bottom surface 18 of the casing 12 or the liner 40 inside the internal compartment 14. The same would be true if the toy assembly 10 were made without the windows 44.

Figure 4:
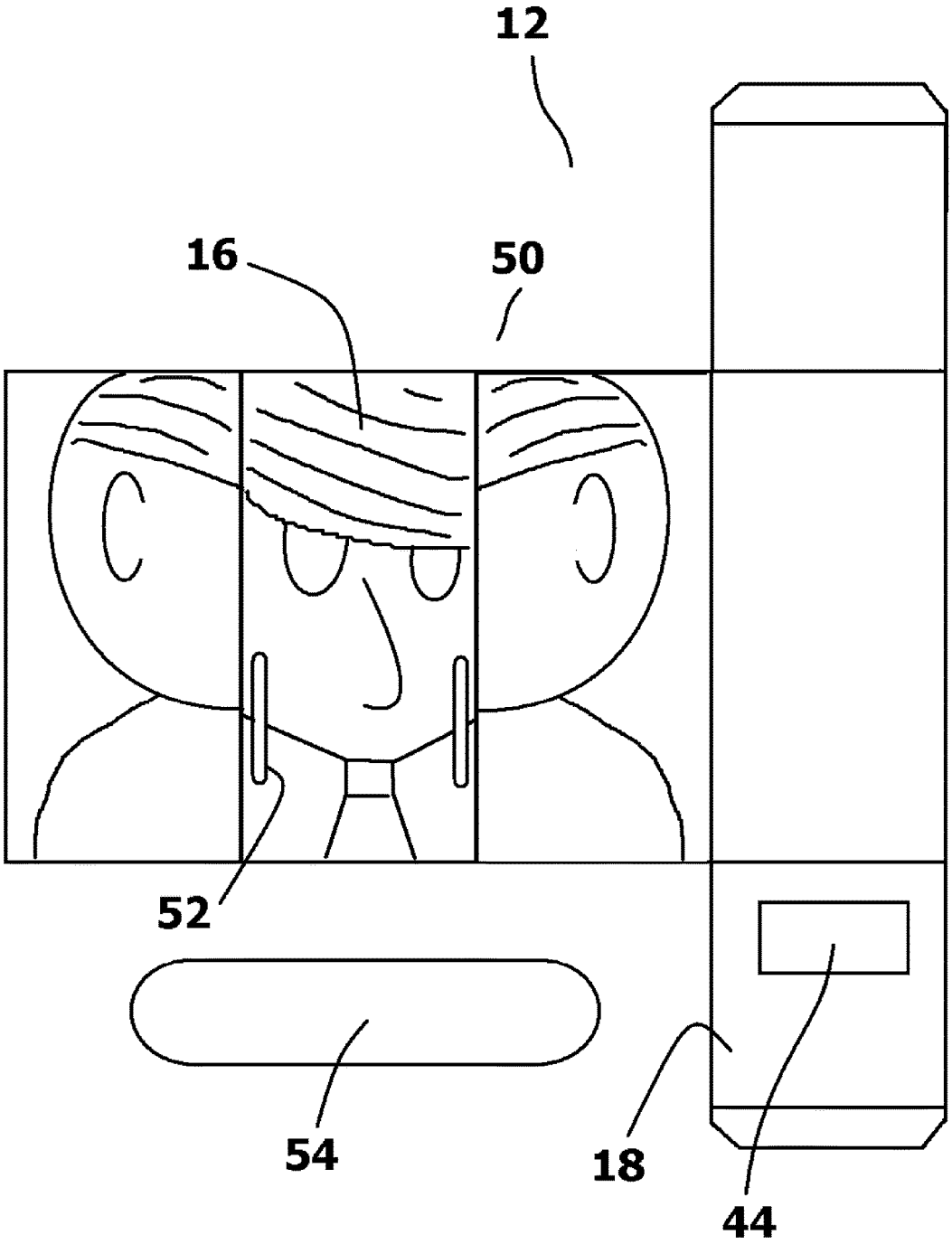
FIG. 4 shows a blank of paper used to form the casing of the exemplary embodiment.

Referring to FIG. 4 in conjunction with FIG. 2 and FIG. 3, it will be understood that as the vibration mechanism 20 vibrates, it moves and transfers energy to the casing 12. This causes the casing 12 to move. The way the casing 12 moves depends upon the orientation of the vibration mechanism 20 within the casing 12. The movement of the casing 12 also depends upon whether or not the vibration mechanism 20 is resting in a window 44. As such, each time the vibration mechanism 20 is activated, its effects upon the movement of the casing 12 will differ. Additionally, as the vibration mechanism 20 vibrates, it changes its orientation within the internal compartment 14 of the casing 12. As a consequence, the effects of the vibration mechanism 20 on the movements of the casing 12 continuously change as a function of time. The results are movement patterns for the casing 12 and the overall toy assembly 10 that are diverse, unpredictable, and always changing.

The casing 12 can be molded of thin plastic. However, the casing 12 can also be made of a foldable sheet material, such as paper or paperboard. Referring to FIG. 4 in conjunction with FIG. 3, it can be seen that the casing 12 can be manufactured as a flat blank 50. Graphics 16 can be printed onto the flat blank 50. The flat blank 50 can then be folded into the box structure that is the casing 12. In this manner, numerous different casings 12 can be sold with the vibration mechanism 20 without significantly increasing the costs of manufacturing the overall product.

The graphics 16 on the casing 12 can represent the body of a character. To add arms or other appendages to the casing 12, slots 52 can be formed in the sidewalls 38 of the casing 12. Appendages 54, in the form of folded pieces of paperboard, can be inserted into the slots 52 so that the appendages 54 extend away from the casing 12. The appendages 54, in addition to improving aesthetics, also prevent the casing 12 from falling in the directions of the extending appendages 54. Rather, should the internal vibration mechanism 20 cause the casing 12 to fall forward, the extending appendages 54 can hold the casing 12 at an inclined angle that can enable the casing 12 to stand up straight once the vibration mechanism 20 again shifts within the internal compartment.

Figure 5:
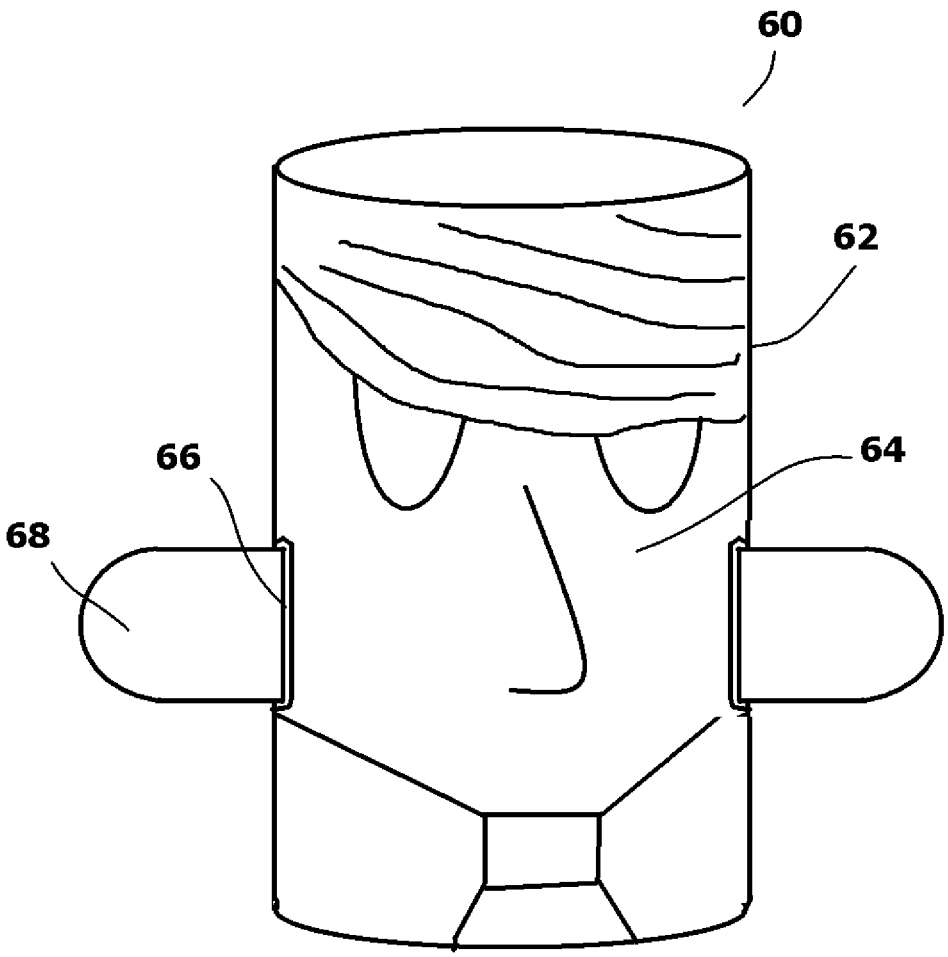
FIG. 5 shows an alternate embodiment of a vibrating toy assembly.
Figure 6:
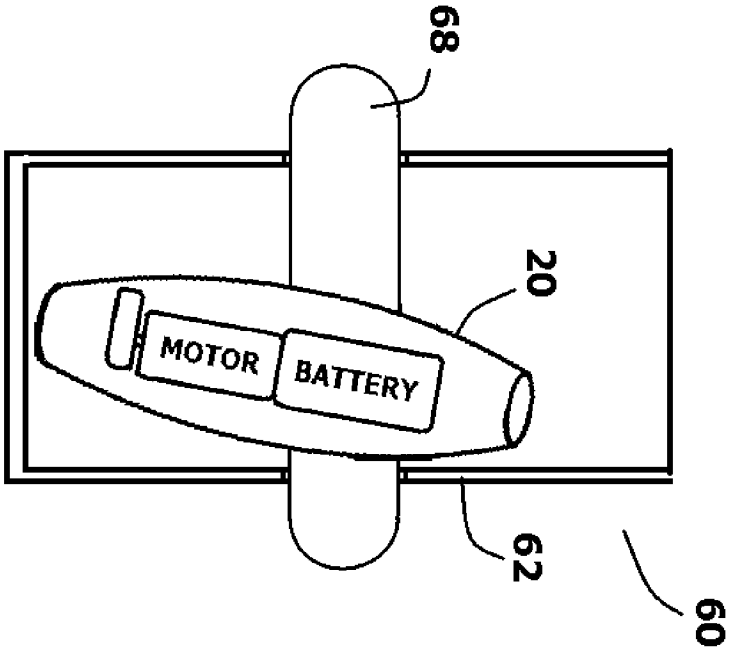
FIG. 6 is a cross-sectional view of the embodiment of FIG. 5.

Referring to FIG. 5 and FIG. 6, an alternate embodiment of a toy assembly 60 is shown. In this embodiment, the same vibration mechanism 20 is used. As such, the vibration mechanism 20 is identified with the same reference number as was previously used.

In this embodiment, the casing 62 of the toy assembly 60 is shaped as a cylindrical tube. The casing 62 is made by bending a blank of cut paper. No liner is used in this embodiment. Graphics 64 are printed onto the casing 62. Additionally, slits 66 are formed in the casing 62 so that folded segments of paper 68 can serve as extending appendages. It will be understood that the embodiments of the present invention that are illustrated and described are merely exemplary and that a person skilled in the art can make many variations to those embodiments. All such alternate embodiments are intended to be included within the scope of the present invention as defined by the claims.

What is claimed is:

1. A vibrating toy assembly, comprising:

a vibration mechanism having a motor and batteries held in a housing, wherein said vibration mechanism vibrates when activated;

a hollow casing that defines an internal compartment having a bottom surface and at least one side wall, wherein said internal compartment is large enough to receive said housing of said vibration mechanism in a variety of orientations;

an opening formed in said bottom surface of said internal compartment that enable said vibration mechanism inside said internal compartment to contact a surface outside said internal compartment when activated;

wherein said vibration mechanism is positioned within said internal compartment and activated, therein causing said vibration mechanism to vibrate and move said casing, wherein said vibration mechanism moves through at least some of said variety of orientations within said casing, therein creating changing patterns of movement for said casing.

2. The assembly according to claim 1, wherein said housing is elongated between two ends and said internal compartment within said casing is sized to orient said vibration mechanism so that one of said ends rests upon said bottom surface of said internal compartment.

3. The assembly according to claim 1, further including a liner for lining at least part of said internal compartment between said casing and said vibration mechanism.

4. The assembly according to claim 3, wherein said casing is fabricated from folded paper.

5. The assembly according to claim 4, wherein said liner is a plastic liner that reinforces said casing.

6. The assembly according to claim 4, wherein graphics are printed on said casing that provide said casing with an external appearance of a character.

7. The assembly according to claim 1, further including appendages that extend from said casing and prevent said casing from falling flat when tipped.

8. The assembly according to claim 1, wherein said casing is rectangular in shape, being fabricated from a folded blank of material.

9. The assembly according to claim 1, wherein said casing is cylindrical in shape.

10. A vibrating toy assembly, comprising:

a vibration mechanism that vibrates when activated;

a casing formed from a folded paper blank, wherein said casing defines an internal compartment with a bottom surface that receives said vibration mechanism therein, wherein said vibration mechanism causes said casing to vibrate and move; and an opening in said bottom surface that enables said vibration mechanism vibrating inside said internal compartment to contact a surface outside said internal compartment.

11. The assembly according to claim 10, wherein said internal compartment within said casing is larger than said vibration mechanism and said vibration mechanism changes orientations within said internal compartment as said vibration mechanism vibrates.

12. The assembly according to claim 10, further including a liner for lining at least part of said internal compartment between said casing and said vibration mechanism.

13. The assembly according to claim 12, wherein said liner is a plastic liner that reinforces said casing.

14. The assembly according to claim 10, wherein said vibration mechanism includes a motor and batteries encased in an elongated housing.

15. The assembly according to claim 10, wherein graphics are printed on said casing that provide said casing with an external appearance of a character.

16. A vibrating toy assembly, comprising:

a vibration mechanism that vibrates when activated;

a folded paper casing that defines an internal compartment, wherein said internal casing has a first bottom surface with a first opening formed therein;

a plastic liner disposed within said internal compartment for reinforcing said casing, wherein said plastic liner defines an open pocket that receives said vibration mechanism therein, said open pocket having a second bottom surface with a second opening formed therein, wherein said second opening aligns with said first opening and enables said vibration mechanism vibrating inside said open pocket to contact a surface outside said folded paper casing, wherein said vibration mechanism vibrates and moves said liner and said casing when activated.

17. The assembly according to claim 16, wherein said vibration mechanism includes a motor and batteries encased in an elongated housing, wherein said housing is free to move within said open pocket.

* * * * *